US011855382B2

(12) United States Patent
Fong

(10) Patent No.: US 11,855,382 B2
(45) Date of Patent: Dec. 26, 2023

(54) LOADBREAK BUSHING

(71) Applicant: ABB Schweiz AG, Baden (CH)

(72) Inventor: Robert Fong, Bethlehem, PA (US)

(73) Assignee: ABB Schweiz AG, Baden (CH)

( * ) Notice: Subject to any disclaimer, the term of this patent is extended or adjusted under 35 U.S.C. 154(b) by 61 days.

(21) Appl. No.: 17/583,513

(22) Filed: Jan. 25, 2022

(65) Prior Publication Data

US 2023/0238737 A1 Jul. 27, 2023

(51) Int. Cl.
*H01R 13/53* (2006.01)
*H01R 13/52* (2006.01)
*H01R 13/405* (2006.01)

(52) U.S. Cl.
CPC ..... *H01R 13/53* (2013.01); *H01R 13/405* (2013.01); *H01R 13/5202* (2013.01)

(58) Field of Classification Search
CPC ..... H01R 13/53; H01R 13/6485; H01R 13/5202; H01R 13/405
USPC ..... 439/181, 921, 187, 183, 185
See application file for complete search history.

(56) References Cited

U.S. PATENT DOCUMENTS 3,958,855 A * 5/1976 Oakes ..... H01R 13/53 218/90
3,997,235 A * 12/1976 Boliver ..... H01R 13/53 218/90
4,068,913 A * 1/1978 Stanger ..... H01R 13/53 218/147
4,088,383 A * 5/1978 Fischer ..... H01R 13/53 439/185
4,202,591 A * 5/1980 Borgstrom ..... H01R 13/53 439/185
4,516,823 A * 5/1985 Filter ..... H01H 33/045 439/184
4,773,872 A 9/1988 Borgstrom et al.
4,863,392 A * 9/1989 Borgstrom ..... H01R 13/53 439/185
5,393,240 A * 2/1995 Makal ..... H01R 13/53 439/187

(Continued)

OTHER PUBLICATIONS

Muench, F. et al.; POSI-Break Loadbreak Connector System—Certified Test Report; Cooper Power Systems; Aug. 18, 1998; 10 pages.

(Continued)

*Primary Examiner* — Gary F Paumen
(74) *Attorney, Agent, or Firm* — Armstrong Teasdale LLP

(57) ABSTRACT

A female electrical connector for use in a separable connector assembly is provided. The female electrical connector includes an elongate insulative body and a female contact disposed within the body. The female electrical connector also includes a tubular support sleeve extending between a first end and a second end. The first end of the tubular support sleeve is connected to the female contact. The tubular support sleeve defines a cavity at the second end. The female electrical connector further includes an insulating coupling connected to the second end of the tubular support sleeve. The insulating coupling includes an insulating sleeve that is moveable between a retracted position, where the insulating sleeve is retracted within the cavity of the tubular support sleeve, and an extended position, where the insulating sleeve extends outward from the cavity and away from the second end of the tubular support sleeve.

20 Claims, 9 Drawing Sheets

(56) References Cited

U.S. PATENT DOCUMENTS

| | | | | |
|---|---|---|---|---|
| 5,445,533 | A * | 8/1995 | Roscizewski | H01R 13/53 439/184 |
| 5,655,921 | A | 8/1997 | Makal et al. | |
| 5,957,712 | A * | 9/1999 | Stepniak | H01R 13/53 439/187 |
| 7,083,450 | B1 | 8/2006 | Hughes | |
| 7,648,376 | B1 | 1/2010 | Borgstrom | |
| 9,112,322 | B2 * | 8/2015 | Siebens | H01R 13/17 |
| 2011/0034051 | A1 * | 2/2011 | Kumar | H01R 13/111 439/186 |

OTHER PUBLICATIONS

Hughes, D.; Recognizing the Product Evolution that Tamed Partial Vacuum Induced Flashovers in 25 kV Class Loadbreak Separable Insulted Connector Systems; IEEE 386-2016; 3 pages.

* cited by examiner

LOADBREAK BUSHING

BACKGROUND

The field of the disclosure relates generally to separable electric connector assemblies and, more particularly, to loadbreak bushings adapted for use in separable electrical connector assemblies.

High-voltage separable connector assemblies typically interconnect sources of energy such as transformers to distribution networks or the like. Known separable connector assemblies include a male contact connector, typically in the form of an elbow connector, and a female contact connector, typically in the form of a bushing insert. The elbow connector is coupled to a power cable and includes a male electrical probe positioned within a cavity defined by the elbow connector. The male electrical probe extends outward from the elbow connector through an opening at a location opposite the separable connector end that includes the power cable. In use, the bushing insert is electrically coupled to a bushing well of a transformer. The bushing insert includes a female electrical contact. When the separable connector assembly is formed, a portion of the bushing insert is located in the cavity of the elbow connector and the female contact of the bushing receives the male electrical probe extending from the elbow connector, thereby creating an electrical connection between the transformer and the power cable. Frequently, the connector is disassembled by separating the elbow and the bushing insert. The disassembly and disconnection of such energized components like the elbow and bushing is referred to as "loadbreak". Separating the elbow and bushing typically creates a break in the electrical connection. However, in the event the electrical connection is not otherwise broken before the elbow and bushing disconnection, the loadbreak operation may create, or at least contribute to creating, the occurrence of relatively dangerous flashover event between the energized electrical components and a nearby ground.

For example, when the bushing insert is received into the cavity of the elbow connector that is operably connected to a power cable, as the bushing is inserted into the cavity, the loadbreak bushing may displace a volume of air that was located in at least a portion of the cavity and replaced by the bushing. The reduction in air pressure can negatively impact the dielectric strength/insulating properties of the air. The elbow and/or bushing can also be configured to enable the formation of a seal, such as, for example, a dust or moisture seal, located proximate the interface between the elbow and the bushing. Thus, in the event the elbow is to be physically disconnected from the bushing, the initial displacement of the elbow relative to the bushing may create a vacuum within the cavity of the elbow. In addition, the seal between the elbow and bushing may limit the flow of air into the cavity. The combination of the vacuum formed within the cavity and the restriction of air flow to fill the vacuum decreases the pressure within the cavity, which can thereby decrease the dielectric strength of the air in the cavity, and more specifically, decrease the dielectric strength of the air along the interface between the bushing and the elbow.

Such a decrease in the dielectric strength of the air can at least contribute to the occurrence of a dangerous flashover event. In particular, when the energized male probe becomes exposed to the air during the loadbreak operation, the reduced dielectric strength of the surrounding air along the interface between the bushing and the elbow may induce a flashover between the exposed probe and a nearby grounding plane. Typically, the bushing insert includes an external, conductive jacket surrounding a mid-section of the bushing adjacent the portion of the bushing that is inserted into the cavity of the elbow. As such, the conductive jacket is positioned proximate the interface between the bushing and the elbow, and the proximity of the conductive jacket to the exposed energized male probe during loadbreak may be such that a flashover event between the conductive jacket and the male probe may occur. A flashover distance can be defined as the distance between the conductive jacket and the energized male probe once the male probe becomes exposed. Because the reduction in dielectric strength is a transient condition, increasing the flashover distance during loadbreak can facilitate reducing the potential of a flashover event. That is, increasing the flashover distance can prevent the energized male probe from becoming exposed until after the transient dielectric breakdown along the interface between the bushing and the elbow has sufficiently ended, such that a risk of potential flashover between the male probe and the conductive jacket is substantially minimized. Additionally, increasing the flashover distance can prevent the energized male probe from becoming exposed until the distance between the conductive jacket and the exposed probe is sufficiently far enough such that a flashover cannot reasonably occur, even if the male probe becomes exposed in the presence of air having reduced dielectric strength. While efforts have been made to increase the flashover distance, problems remain in preventing such flashover events.

Accordingly, there is a need to provide a separable connector assembly that overcomes the challenges in the art related to flashover risks during a loadbreak operation. In particular, there is a need to increase a flashover distance between the energized male probe and the external, conductive jacket on the bushing during loadbreak.

BRIEF DESCRIPTION

In one aspect, a female electrical connector for use in a separable connector assembly is provided. The female electrical connector includes an elongate insulative body and a female contact disposed within the body. The female electrical connector also includes a tubular support sleeve extending between a first end and a second end. The first end of the tubular support sleeve is connected to the female contact. The tubular support sleeve defines a cavity at the second end. The female electrical connector further includes an insulating coupling connected to the second end of the tubular support sleeve. The insulating coupling includes an insulating sleeve that is moveable between a retracted position, where the insulating sleeve is retracted within the cavity of the tubular support sleeve, and an extended position, where the insulating sleeve extends outward from the cavity and away from the second end of the tubular support sleeve.

In another aspect, a separable connector assembly is provided. The separable connector assembly includes a male connector and a female connector. The male connector has a first end connected to an electric power cable and a second end that has an opening. The male connector includes a conductive male contact that extends outward from the opening. The female connector includes an elongate insulative body that has a first body end and a second body end. The first body end is inserted into the opening of the second end of the male connector to form the separable connector assembly. The female connector also includes a conductive shield that surrounds a portion of the body between the first body end and the second body end. The female connector further includes a female contact that is disposed within the body. The female contact receives the male contact when the first end of the body is inserted into the male connector. The female connector also includes a tubular support sleeve that extends between a first support sleeve end and a second support sleeve end. The first support sleeve end is connected to the female contact that is disposed within the body. The tubular support sleeve defines a cavity at the second support sleeve end. The female connector further includes an insulating coupling connected to the second support sleeve end. The insulating coupling includes an insulating sleeve that is moveable between a retracted position where the insulating sleeve is retracted within the cavity of the tubular support sleeve and an extended position where the insulating sleeve extends outward from the cavity and away from the second support sleeve end. The insulating sleeve moves to the extended position when the male connector is pulled away from the female connector to increase a longitudinal distance between an exposed portion of the male contact and an externally exposed portion of the conductive shield of the female connector.

In yet another aspect, a separable connector assembly is provided. The separable connector assembly includes a male connector and a female connector. The male connector has a first end and a second end. The male connector includes a housing that extends from the first end to the second end of the male connector. The second end of the male connector has an opening. The male connector further includes a conductor contact positioned within the housing and a conductive male contact. The male contact extends between a first contact end that is connected to the conductor contact and a second contact end that is located outward from the opening. The female connector includes an elongate insulative body that has a first body end and a second body end. The first body end is inserted into the opening of the second end of the male connector to form the separable connector assembly. The female connector also includes a female contact that is disposed within the body. The female contact receives the second contact end of the male contact when the first end of the body is inserted into the male connector. The female connector also includes a tubular support sleeve that extends between a first support sleeve end and a second support sleeve end. The first support sleeve end is connected to the female contact disposed within the body. The tubular support sleeve defines a cavity at the second support sleeve end. The female connector further includes an insulating coupling that is connected to the second support sleeve end. The insulating coupling includes an insulating sleeve that has a first insulating sleeve end and a second insulating sleeve end. The insulating sleeve is moveable between a retracted position where the first insulating sleeve end is located inside the cavity of the tubular support sleeve and an extended position where the first insulating sleeve end is located outside the cavity. The insulating sleeve moves to the extended position when the male connector is pulled away from the female connector such that the second insulating sleeve end continues to cover a portion of the male connector adjacent the first connector end over a longitudinal distance.

DETAILED DESCRIPTION

Figure 1:
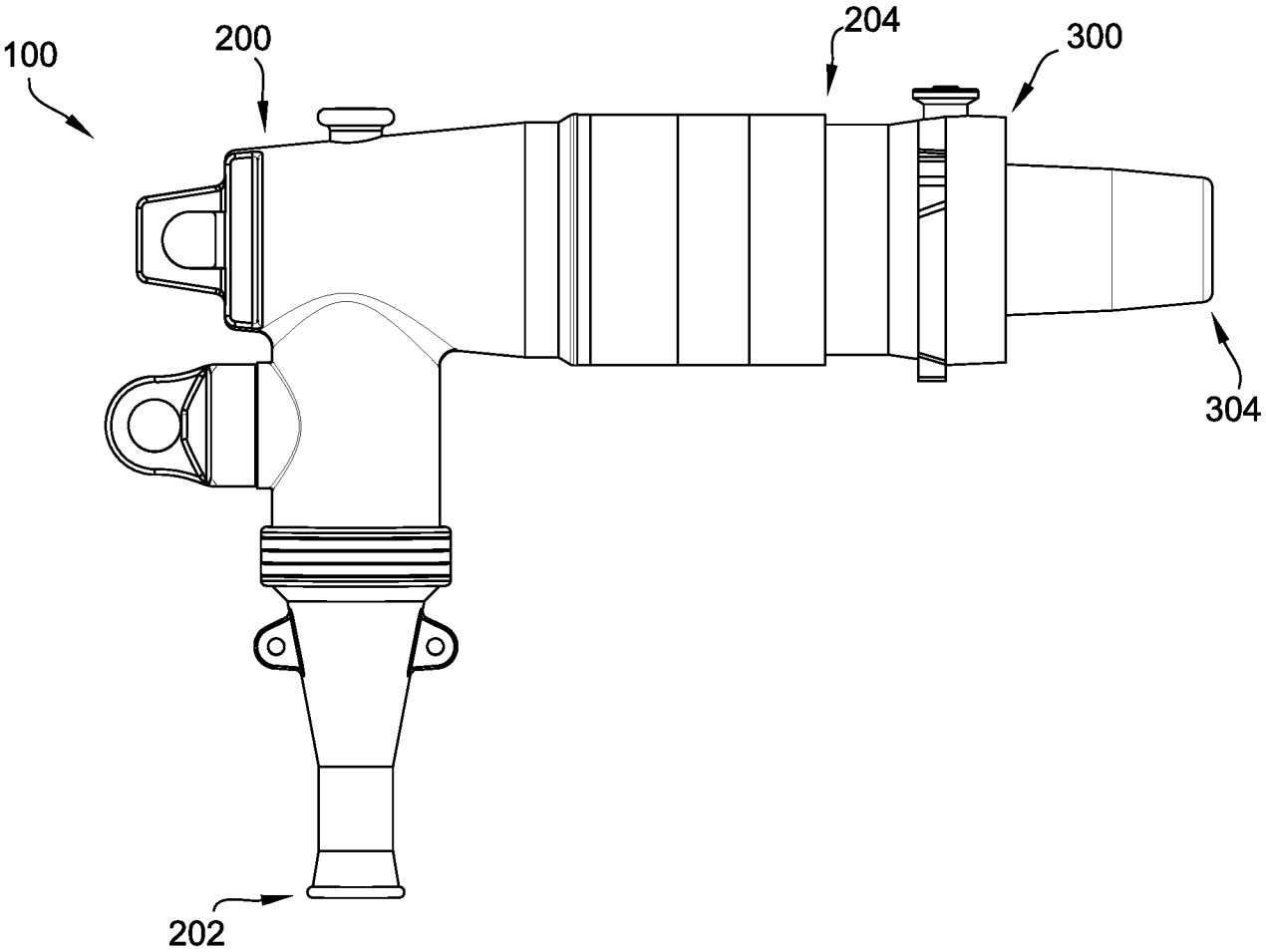
FIG. 1 is an elevation view of a separable connector assembly.

FIG. 1 is an elevation view of a separable or loadbreak connector assembly 100. As the detailed description proceeds, assembly 100 may be referred to as either "assembly", "separable connector assembly" or "separable loadbreak connector assembly". All refer to the same assembly 100. Assembly 100 includes a male contact loadbreak connector 200, shown as an elbow connector 200, coupled to a female contact loadbreak connector 300, shown as a bushing insert 300. As the description proceeds, connector 200 may be referred to as either "male loadbreak connector" or "male connector" or "elbow connector" or "elbow" and connector 300 may be referred to as either "female contact loadbreak connector" or "female connector" or "bushing insert" or "bushing". Elbow connector 200 has a first end 202 adapted to connect to an electrical power cable (not shown) and a second end 204 that receives a first end 302 (shown in FIG. 3) of bushing insert 300. A second end 304 of bushing insert 300, opposite first end 302, is adapted to connect to and be seated within a bushing well (not shown) of a transformer or other electrical equipment (not shown). When coupled to form separable connector assembly 100, the elbow connector 200 and bushing insert 300 achieve an electrical connection and complete a high-voltage circuit between the power cable and the transformer. Elbow connector 200 and bushing insert 300 are therefore suitably adapted for use in a high-voltage environment. For example, the elbow connector 200 and bushing insert 300 may each be a 15 kV, 25 kV, or 35 kV class loadbreak connector component.

Figure 2:
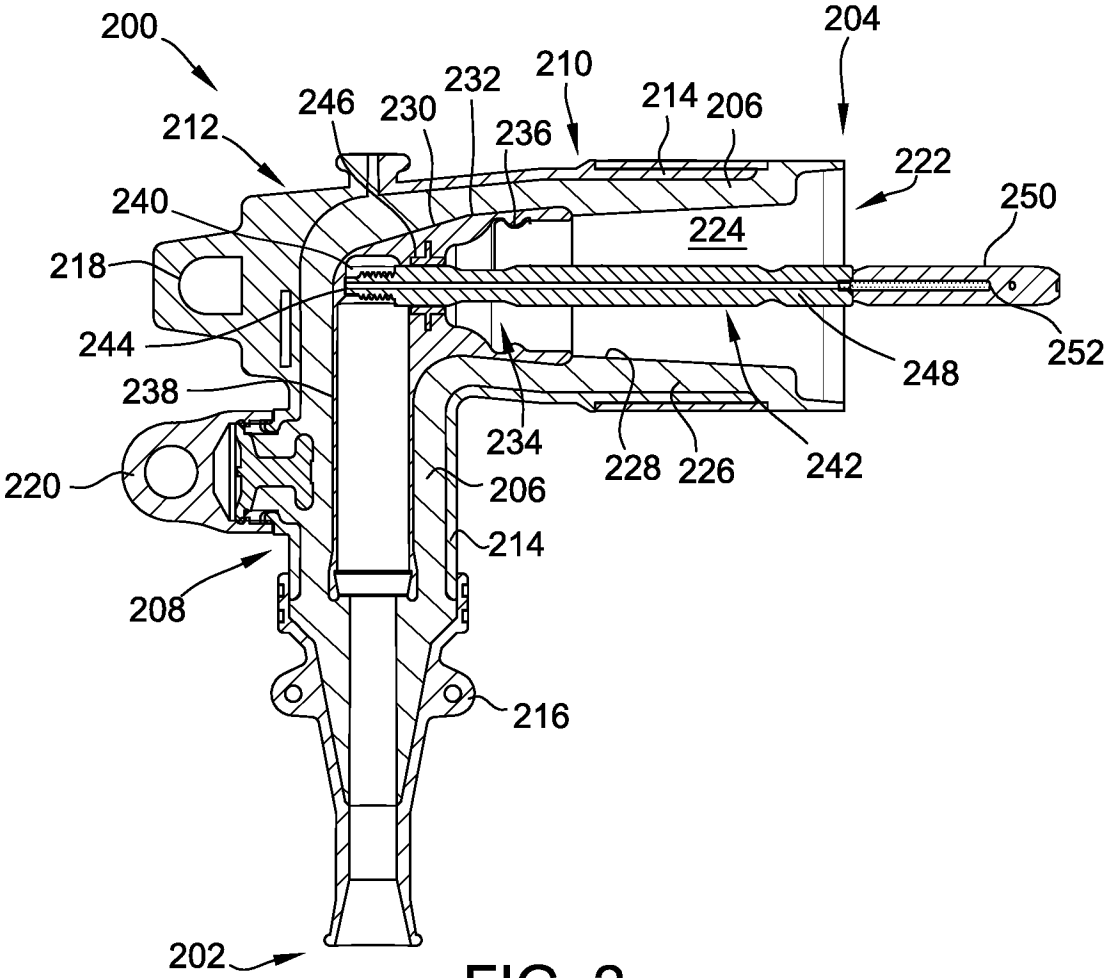
FIG. 2 is a cross-sectional view of an elbow connector for use in the separable connector assembly shown in FIG. 1.

FIG. 2 is a cross-sectional view of a loadbreak elbow connector 200 for use in the separable connector assembly 100 (shown in FIG. 1). The elbow connector 200 includes a hollow, electrically-insulating, elbow-shaped housing 206 that is suitably formed of a plastic or electrically insulative material, such as rubber, synthetic rubber, plastic or the like, for example, ethylene propylene diene monomer (EPDM) rubber. Elbow connector 200 defines a lower vertical portion 208 that extends from first end 202 to central portion 212. Vertical portion 208 connects at central portion 212 to an upper horizontal portion 210 that extends from second end 204 to central portion 212. It should be understood that although the elbow connector portions are described as a vertical portion and a horizontal portion, the use of "vertical" or "horizontal" should not limit the scope of the disclosure and that loadbreak connector assembly can be used in alternate orientations that are not specifically disclosed herein. A semiconductive shield 214 surrounds housing 206. Semiconductive shield 214 includes grounding tabs 216 that may be coupled to a grounding conductor (not shown). A bail 218 extends horizontally outward from the central portion 212. Bail 218 connects to an electrically insulative tool (e.g., a fiberglass hotstick) to enable an operator to pull elbow connector 200 away from bushing insert 300 to disconnect and disassemble separable connector assembly 100. A test point 220 is located along vertical portion 208 between bail 218 and tabs 216. Test point 220 may include an electrode that indicates whether a circuit within elbow connector 200 is energized.

The housing 206 includes an opening 222 formed at second end 204 and a cavity 224 defined by housing wall 226 and extending from the opening 222 toward central portion 212. The cavity 224 terminates proximate central portion 212. Wall 226 has an inner surface 228 that tapers inwardly as the wall extends from opening 222, toward central portion 212. An annular contact insert 230 is disposed within housing 206 and is suitably formed of a semiconductive material. Contact insert 230 includes a horizontally-disposed portion 232 that defines a recess 234. As shown in FIG. 2, recess 234 is closely adjacent cavity 224, which together form a continuous void space. Circumferential rib 236 extends radially inward and into recess 234. Contact insert 230 also includes vertical portion 238 that is located in lower vertical portion 208 of housing 206 of elbow connector 200. A power cable (not shown) extends through end 202 and vertical portion 238. A conductor contact 240 is positioned within vertical portion 238 of insert 230 and terminates at horizontally-disposed portion 232. Conductor contact 240 is coupled to a terminal end of the power cable (not shown). A male contact or probe 242 has a threaded end 244 that threadably connects probe 242 to conductor contact 240 at the junction of the respective horizontal and vertical portions 232 and 238 of insert 230. Thereby, probe 242 is electrically coupled to the power cable. To provide support for probe 242, an annular contact holder 246, seated in horizontal portion 232 of insert 230, surrounds probe 242 proximate threaded end 244 when probe 242 is connected to conductor contact 240.

Probe 242 has a middle conductive member 248 that extends from threaded end 244 to an arc follower 250. Middle conductive member 248 is substantially contained within cavity 224 and recess 234 and is formed of a conductive material such as copper, for example. Middle conductive member 248 may extend slightly beyond opening 222 formed at the end 204 of connector 200, such that arc follower tip 250 is positioned completely outside cavity 224. Arc follower 250 is formed of ablative material, such as acetal co-polymer resin loaded with finely divided melamine. The ablative material is typically injection molded onto an epoxy bonded glass fiber reinforcing pin 252 to form arc follower 250.

Figure 3:
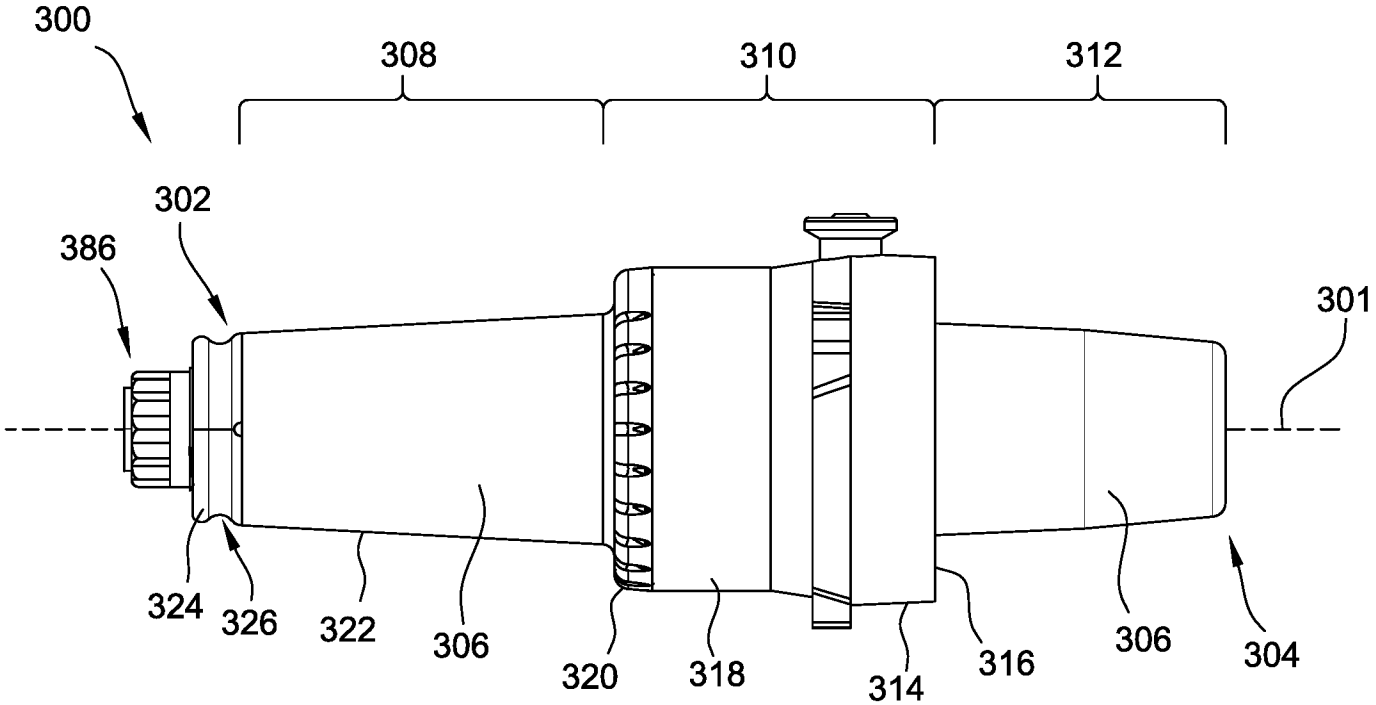
FIG. 3 is an elevation view of an exemplary bushing insert for use in the separable connector assembly shown in FIG. 1.
Figure 4:
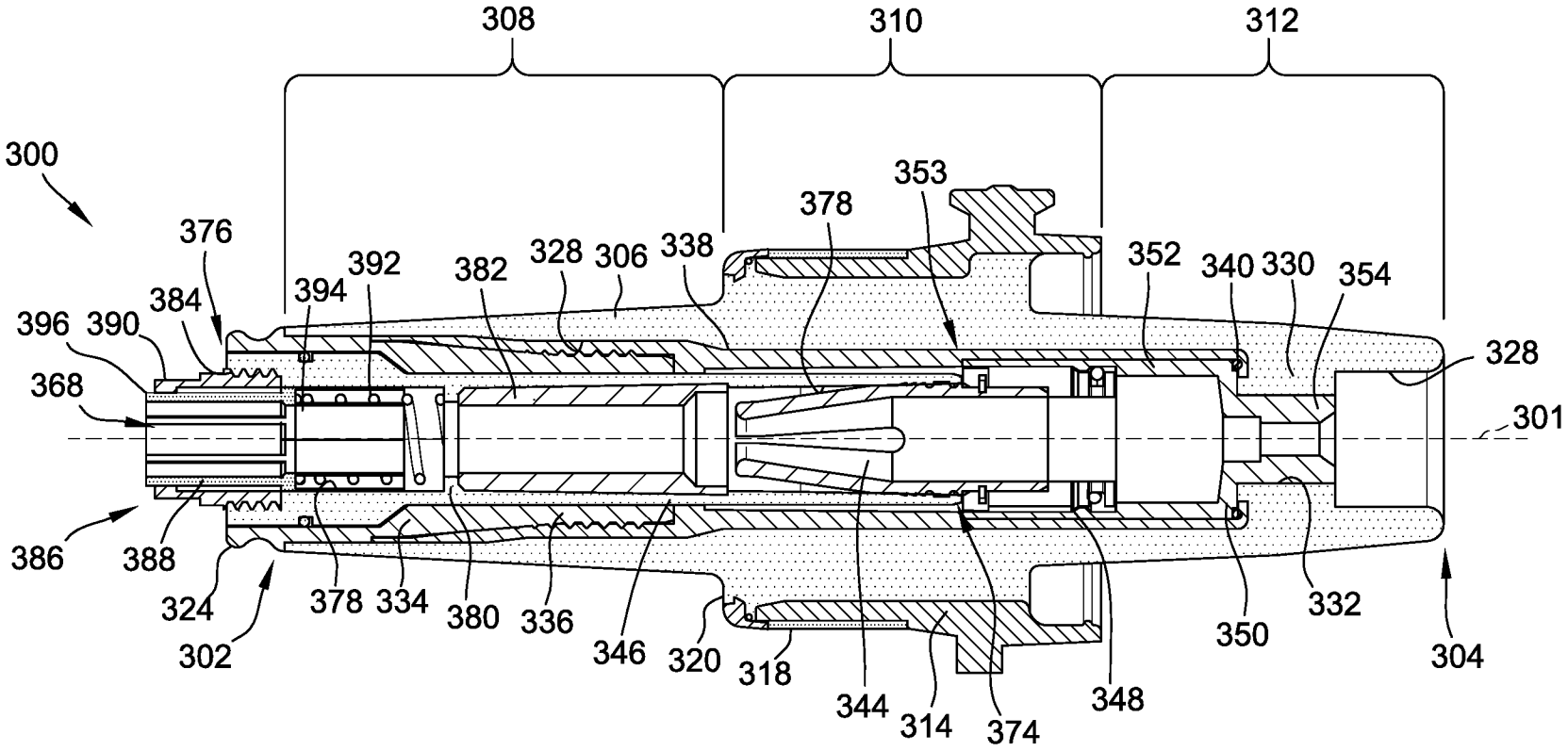
FIG. 4 is a longitudinal cross-sectional view of the bushing insert shown in FIG. 3.
Figure 5:
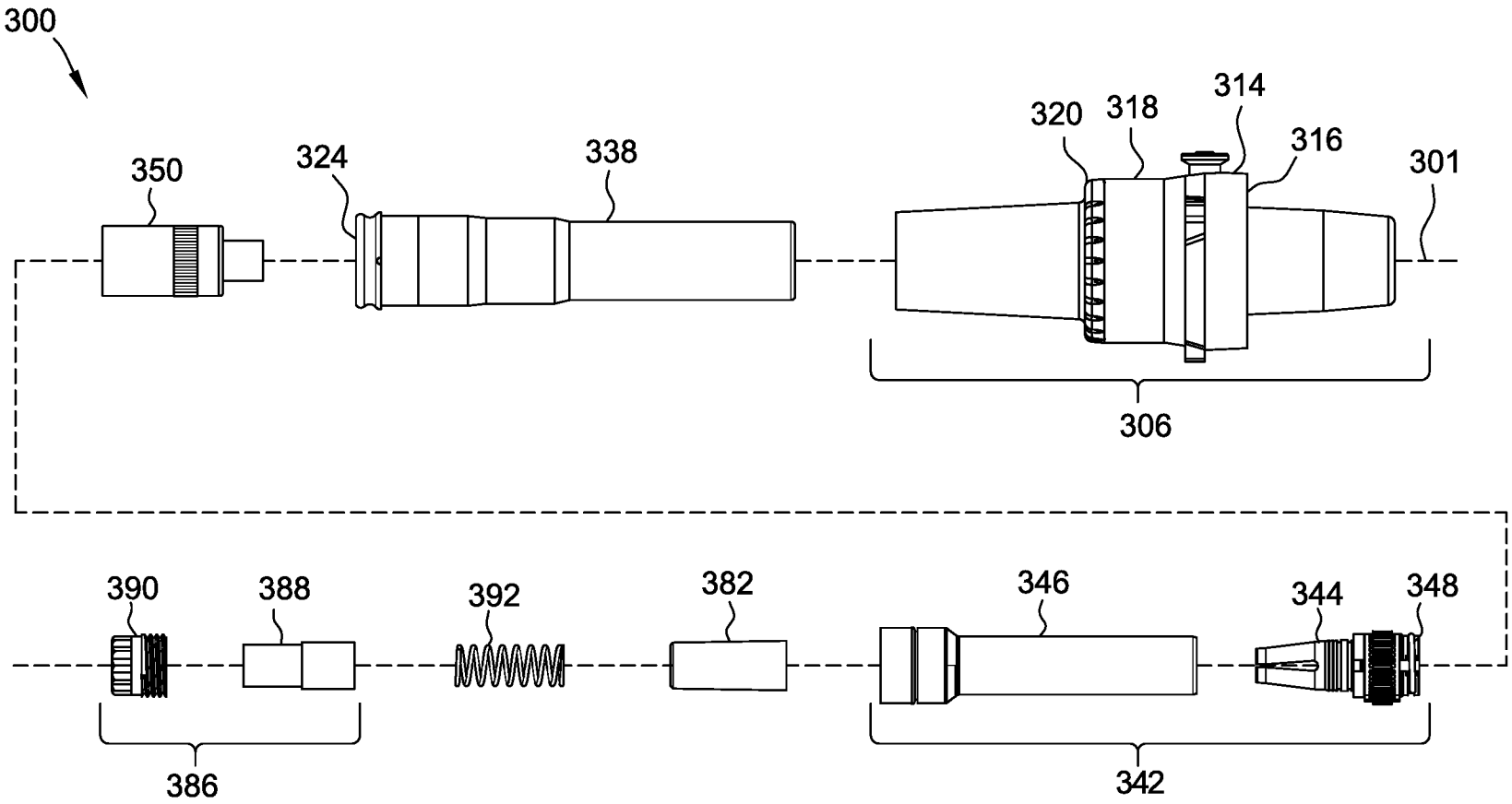
FIG. 5 is an exploded view of the bushing insert shown in FIG. 3.

FIGS. 3-5 show an exemplary bushing insert 300 for use in the separable connector assembly 100 (shown in FIG. 1). Bushing insert 300 has a longitudinal axis 301, a first bushing end 302 and a second bushing end 304. First bushing end 302 is adapted to be inserted into cavity 224 of elbow connector 200. Second end 304 is adapted to connect to and be seated within a bushing well (not shown) of a transformer or other electrical equipment (not shown). Bushing insert 300 includes an elongate, electrically insulative cylindrical body 306 extending between the first bushing end 302 and the second bushing end 304. Body 306 includes a first bushing section 308, a second bushing section 310, and a third bushing section 312. Second bushing section 310 of cylindrical body 306 is located between bushing sections 308 and 310 that in turn are proximate respective ends 302 and 304. An annular conductive shield 314, surrounds and covers second bushing section 310. Conductive shield 314 may be electrically coupled to a ground conductor (not shown). Conductive shield 314 forms a shoulder 316 directed towards second end 304. Shoulder 316 abuts a wall member (not shown) of bushing well (not shown) when bushing insert 300 is fully seated in the transformer. As shown in FIG. 4, a portion of shield 314 opposite shoulder 316 is covered by an insulating jacket 318 that is positioned longitudinally between shield 314 and a vent ring 320. Collectively, vent ring 320, insulating jacket 318 and conductive shield 314 cover second bushing section 310 of body 306. Additionally, jacket 318 and cylindrical body 306 are each suitably formed from a plastic or electrically insulative material, such as rubber, synthetic rubber, plastic or the like, for example, EPDM rubber. As shown in FIG. 3, shoulder 316 and vent ring 320 define the longitudinal boundaries of middle section 310 along longitudinal axis 301.

First bushing section 308 of the cylindrical body 306 includes an outer surface 322 that tapers inwardly toward axis 301 as outer surface 322 extends from vent ring 320 to a nose tip 324 along longitudinal axis 301. The tapered outer surface 322 has substantially the same taper as tapered inner surface 228 of wall 226 of elbow connector 200 (shown in FIG. 2) and the similar structure enables first bushing section 308 to be located in cavity 224. Additionally, when assembled, surfaces 228 and 322 of the respective wall 226 and first bushing section 308 form a watertight seal therebetween. Nose tip 324 is sized and shaped to fit within recess 234 and includes a groove 326. When inserted in cavity 224, groove 326 receives rib 236 (shown in FIG. 2) to form a snap-fit between bushing insert 300 and elbow connector 200, and prevent the unintended displacement of elbow connector 200 relative to bushing insert 300 along axis 301.

As shown in the sectional view of FIG. 4, cylindrical body 306 is hollow and has a central bore 328 extending longitudinally along axis 301 therethrough. An inwardly directed circumferentially extending collar 330 is formed along the wall of bore 328 proximate end 304 and along third bushing section 312. Collar 330 defines an opening 332. Nose tip 324 is located at housing end 302 substantially outside bore 328 adjacent first section 308 of cylindrical body 306. Nose tip 324 is joined to a nose body 334 that extends longitudinally inwardly within bore 328 from nose tip 324 to a threaded end 336. The threaded end 336 is threadably connected to a metallic, tubular housing 338 positioned within central bore 328 radially outwardly from body 334. The metallic housing 338 extends from threaded end 336 of nose body 334 to an end 340 that is in abutment with collar 330.

As assembled, nose tip 324, nose body 334 and housing 338 define a hollow interior that surrounds a female contact assembly 342 (shown in exploded view in FIG. 5). Female contact assembly 342 includes female contact 344, a tubular support sleeve 346 and a piston 348, each of which are moveable along longitudinal axis 301 relative to housing 338. As will be described in further detail below, female contact 344, tubular support sleeve 346, and piston 348 are connected to move as a single member relative to housing 338. Female contact 344 and piston 348 are each made of electrically conductive metallic material, such as, for example, aluminum, copper, or another suitable metal. Tubular support sleeve 346 is made of an elastomer material.

In addition to the movable female contact assembly 342, a stationary contact member 350 is located adjacent end 340 of metallic housing 338. End 340 is located between stationary contact member 350 and collar 330. Stationary contact member 350 is sized so that member body 352 is in contact with metallic housing 338. Member body 352 is seated in housing 338 and extends longitudinally between end 340 of housing 338 and an open end 353 of member body 352. Stationary contact member 350 also includes a hollow tail 354 extending longitudinally away from body 352 and tail 354 is seated in opening 332 of collar 330. Tail 354 facilitates electrical connection between the female contact assembly 342 and a transformer. For example, tail 354 may have a threaded bore formed therein that receives and mates with a threaded stud of bushing well to form an electrical connection between female contact assembly 342 and the transformer. Body 352 of stationary contact member 350 may be sized and shaped to receive a tool, such as a wrench, that facilitates securing bushing insert 300 to bushing well.

Figure 6:
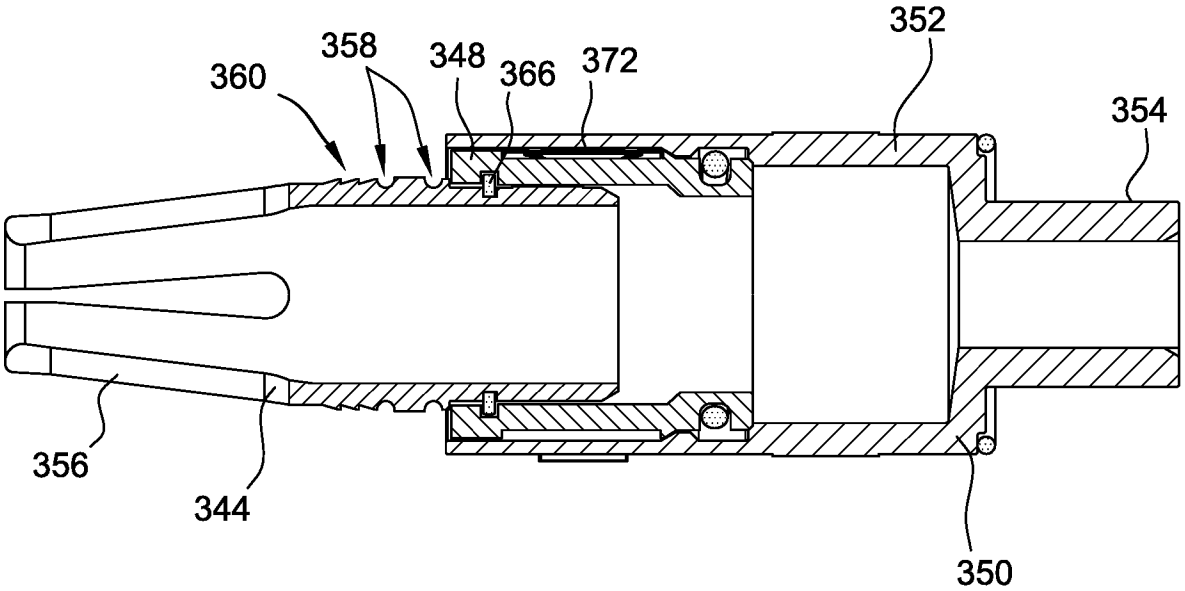
FIG. 6 is an enlarged cross-sectional view of electrical contact components of the bushing insert.
Figure 7:
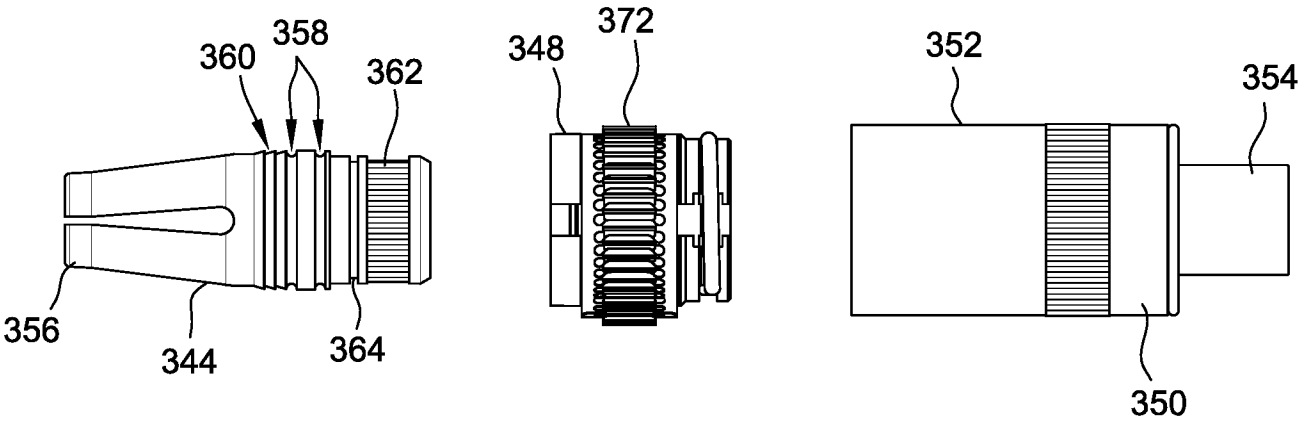
FIG. 7 is an enlarged exploded view of the electrical contact components shown in FIG. 6.

Referring to FIGS. 6 and 7, an enlarged isolated cross-sectional view (FIG. 6) and an enlarged isolated exploded view (FIG. 7) of female contact 344, piston 348, and stationary contact member 350 are shown. Female contact 344 includes a number of longitudinally extending contact fingers 356 at one end and is connected to the piston 348 at the opposite end. Adjacent piston 348 are a pair of discrete serrations 358. A plurality of teeth 360 are located between the flexible contact fingers 356 and serrations 358. Both the serrations 358 and teeth 360 are located along the exterior of the female contact 356 and are aligned longitudinally. Both the teeth 360 and serrations 358 extend circumferentially along the body of the female contact 344. Serrations 358 and teeth 360 engage and grip an inner surface of the elastomer wall of tubular support sleeve 346 at end 374 (shown in FIG. 4), and form an interlocking engagement between female contact 344 and tubular support sleeve 346. The engagement between the teeth 360 and serrations 358 and the inner surface of support sleeve 346 creates a resistance to rotational and longitudinal movement, respectively, of support sleeve 346 relative to the female contact 344. To facilitate connection of female contact 344 and the piston 348, female contact 344 includes an annular array of knurls 362 and a circumferential groove 364 at the end of female contact 344 that connects to piston 348. The piston 348 has an open, tubular body that receives the female contact 344. When female contact 344 is combined with piston 348 and located in the body of piston 348, the array of knurls 362 shears the interior surface of the metallic piston 348. This may advantageously create an unoxidized surface and expose base metal material when female contact 344 is received within piston 348. As shown in FIG. 6, piston 348 includes a spring-loaded snap ring 366 that expands and snaps into a groove 364 to form a permanent, press-fit joint between female contact 344 and piston 348. This configuration eliminates the need for a threaded connection between female contact 344 and piston 348. The connection between female contact 344 and tubular support sleeve 346, and the connection between female contact 344 and piston 348, enables female contact assembly 342 to move as a single member relative to housing 338 along longitudinal axis 301. Piston 348 is surrounded by and secured to a louvered, spring contact ring 372. Contact ring 372 maintains electrical contact between female contact assembly 342 and the other electrical components within body 306 as female contact assembly 342 moves relative to housing 338 along longitudinal axis 301 as described in further detail below.

Referring to FIG. 4, tubular support sleeve 346 is connected to female contact 344 at first tubular support sleeve end 374. Tubular support sleeve 346 extends along longitudinal axis 301 to a second tubular support sleeve end 376. A cavity 378 extends through tubular support sleeve 346 from the first end 374 to the second end 376. An inwardly directed circumferentially extending collar 380 is formed along the wall of cavity 378 of tubular support sleeve 346 proximate second end 376. A guide 382 made of an arc-quenching material is positioned within tubular support sleeve 346. Guide 382 has a hollow, cylindrical body that extends from an end proximate female contact 344 to an end in abutment with collar 380. Tubular support sleeve 346 has internal threads 384 formed at the second end 376.

An insulating coupling 386 is connected to the second end 376 of tubular support sleeve 346. Insulating coupling 386 includes an insulating sleeve 388 and a gland nut 390 that surrounds insulating sleeve 388. Insulating sleeve 388 has a hollow, cylindrical body that is suitably formed of a plastic or electrically insulative material, such as rubber, synthetic rubber, plastic or the like, for example, EPDM rubber. Gland nut 390 is open at both ends. At one end, gland nut 390 has external threads that threadably connect to internal threads 384 at second end 376 of tubular support sleeve 346. Gland nut 390 comprises a head at the end opposite the threaded end. The head is located outside cavity 378 when gland nut 390 is threadably connected to support sleeve end 376. A biasing spring 392 is disposed within cavity 378 of support sleeve 346 between collar 380 and a first end 394 of insulating sleeve 388 of insulating coupling 386. Extension and displacement of spring 392 along longitudinal axis 301 is limited at one end by collar 380 and at the opposite spring end by first end 394 of insulating sleeve 388. Insulating sleeve 388 is moveable relative to second end 376 of support sleeve 346, and relative to gland nut 390, along longitudinal axis 301.

In use, when elbow connector 200 and bushing insert 300 are disassembled, biasing spring 392 urges insulating sleeve 388 along longitudinal axis 301 to an extended position (shown in FIG. 9), where second end 396 of insulating sleeve 388 is located outward from cavity 378 beyond the second end 376 of tubular support sleeve 346. Second end 396 of insulating sleeve 388 is also located outward beyond the head end of gland nut 390 along axis 301 when insulating sleeve 388 is in the extended position. Further, in the extended position, insulating sleeve 388 may be located completely outside cavity 378, that is, first end 394 of insulating sleeve is located beyond second end 376 of support sleeve 346. As insulating sleeve 388 moves to the extended position, first end 394 is prevented from extending outward beyond the head end of gland nut 390 so that insulating coupling 386 remains intact. For example, an outer diameter of insulating sleeve 388 may be greater at first end 394 than at second end 396, such that insulating sleeve 388 moves longitudinally along axis 301 through the open head end of gland nut 390 until a portion of insulating sleeve 388 at first end 394 abuts against the head end of gland nut 390.

Figure 8:
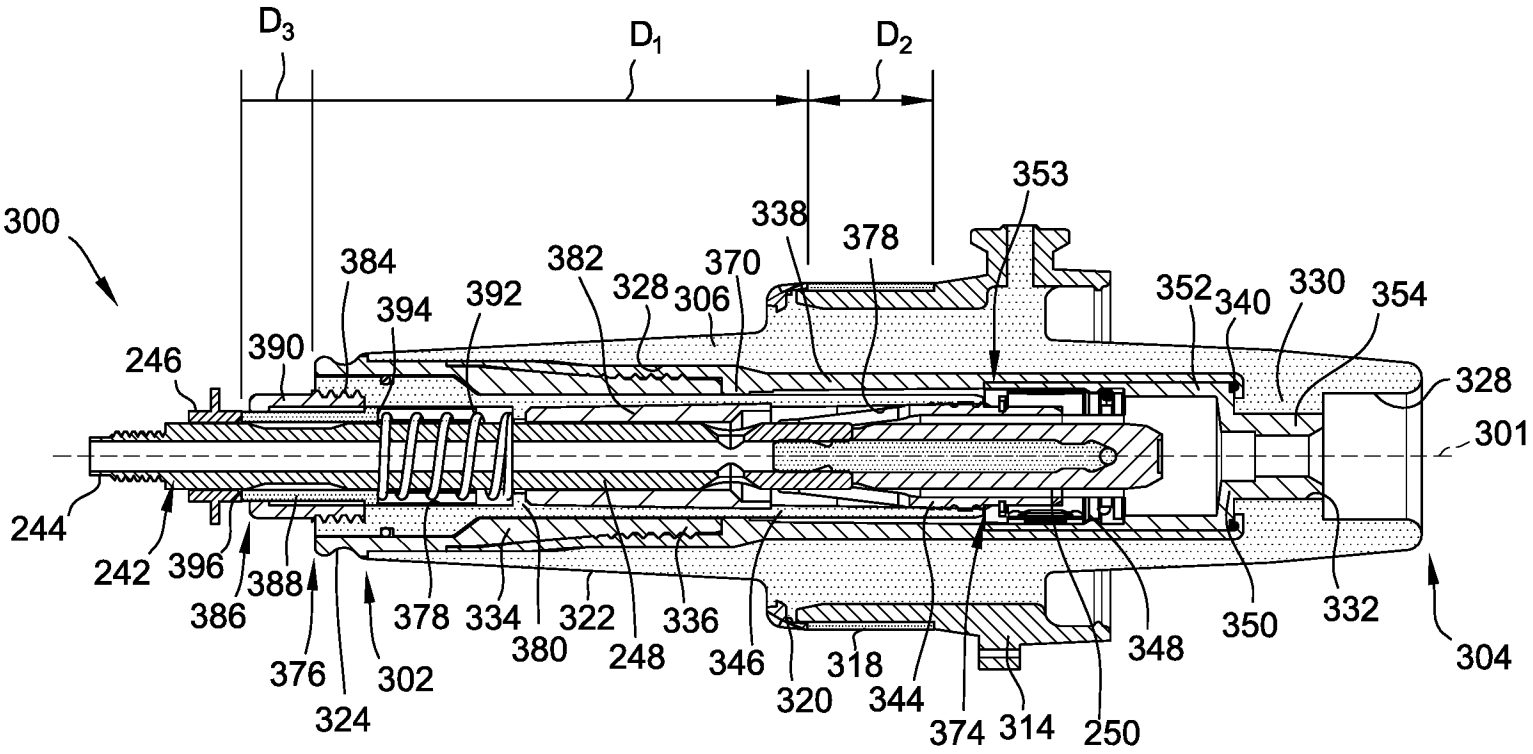
FIG. 8 is a cross-sectional view of the exemplary bushing insert with a probe of the elbow connector of FIG. 2, shown in a location within the bushing insert after the elbow connector and the bushing insert are fully assembled.

Conversely, when elbow connector 200 and bushing insert 300 are assembled, as shown in FIG. 8, annular contact holder 246 contacts second end 396 of insulating sleeve 388, urging insulating sleeve 388 along longitudinal axis 301 to a retracted position, where insulating sleeve 388 is located in gland nut 390 and cavity 378 such that the second end 396 of insulating sleeve 388 is flush with, or extends only slightly beyond, the head of gland nut 390.

Referring generally to FIGS. 1-9, when elbow connector 200 and bushing insert 300 are connected to form separable assembly 100, the male probe 242 is received into an opening 368 at first bushing end 302 of bushing insert 300. In particular, middle conductive member 248 of probe 242 is received within the energized female contact 344 (shown in FIG. 8). As a result, the male probe 242 becomes energized and an arc is formed. The arc formation melts a portion of guide 382 which causes the generation of arc-quenching gases within the housing 338. The arc-quenching gases operate on the piston 348 of the female contact assembly 342 to cause the piston 348, and female contact 344 and tubular support sleeve 346, to move along longitudinal axis 301 away from stationary contact member 350, completing the connection of female contact 344 and male probe 242 to eliminate the arc. Prior to formation of the arc-quenching gases, piston 348 is seated within member body 352 of stationary contact member 350. As a result, the spring contact ring 372 is compressed and facilitates contact between piston 348 and the interior surface of stationary contact member 350 (shown best in FIG. 6). When the arc-quenching gases cause piston 348 to move longitudinally away from stationary contact member 350, spring contact ring 372 expands and maintains contact between piston 348 and the interior surface of metallic housing 338. In this respect, during movement of the female contact assembly 342, electrical contact between the piston 348 and the electrically active metallic housing 338 and/or stationary contact member 350 is maintained by the spring contact ring 372. As the connection progresses to full installation of separable connector assembly 100, male probe 242 urges female contact assembly 342 to the location it maintained within stationary member 250 before elbow connector 200 and bushing insert 300 were assembled.

During a loadbreak operation, elbow connector 200 is pulled away from bushing insert 300 to break the electrical connection between male probe 242 and female contact 344. To facilitate the loadbreak operation, a fiberglass hotstick (not shown) may connect to bail 218 of elbow connector 200. As described herein, a watertight seal is formed between elbow connector 200 and bushing insert 300 when separable assembly 100 is assembled. When elbow connector 200 is pulled away and disconnected from bushing insert 300, the seal is broken which creates a vacuum within cavity 224. The vacuum draws conductive ionized gases proximate the elbow-bushing interface within cavity 224. Additionally, the decreased pressure within cavity 224 due to the created vacuum decreases the dielectric strength of air that initially flows into the cavity 224. The path of air having reduced dielectric strength is located along the outer surface 322. Thus, as conductive member 248 of male probe 242 becomes exposed by pulling elbow connector 200 away from bushing insert 300, a flashover event between the conductive member 248 and conductive jacket 314 surrounding body 306 may occur.

Figure 9:
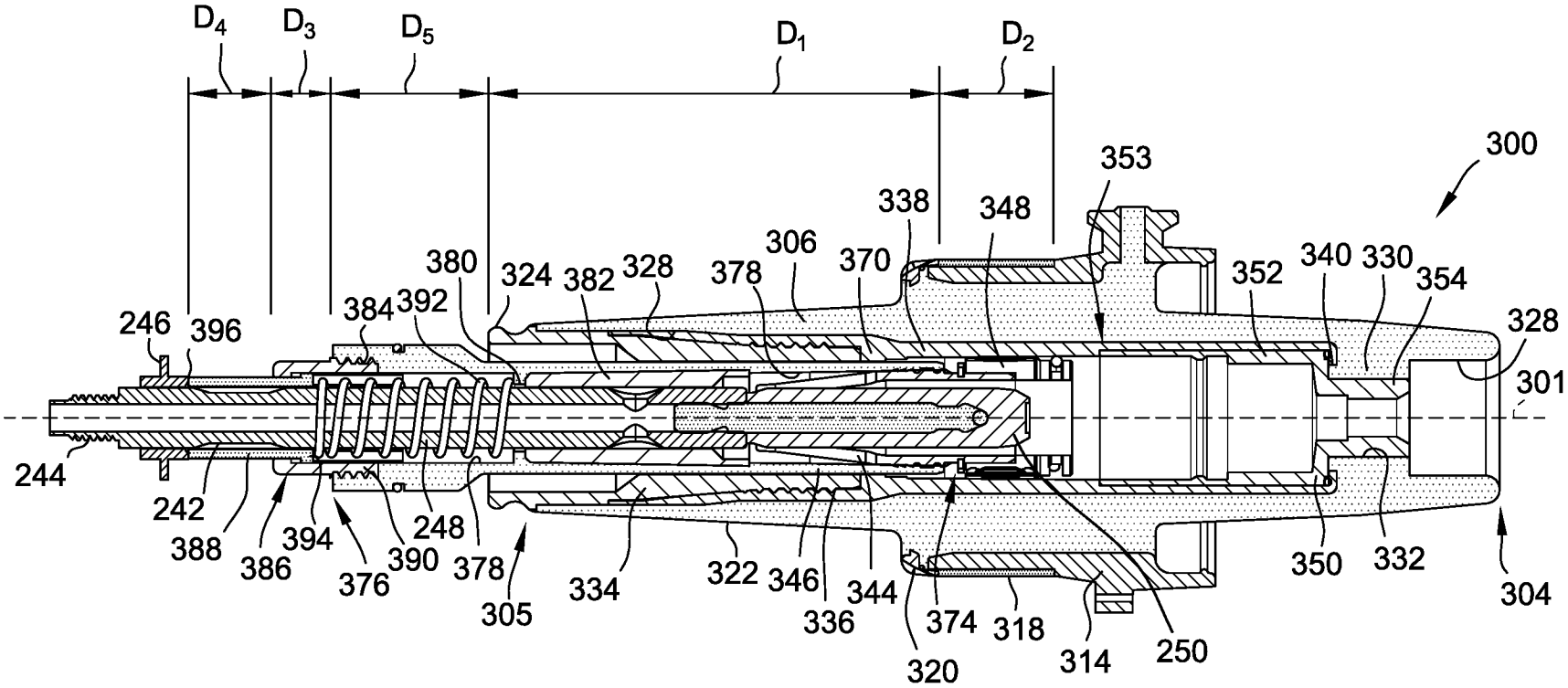
FIG. 9 is a cross-sectional view of the exemplary bushing insert with a probe of the elbow connector of FIG. 2, shown in a location partially outside the bushing insert after the elbow connector has been pulled away from the bushing insert.

To facilitate reducing the risk of such a flashover event, bushing insert 300 is adapted to increase a flashover distance between conductive member 248 and conductive shield 314. As used herein, the term "flashover distance" refers to the longitudinal distance that a flashover arc must travel in order for a flashover event to occur. A flashover arc may be created once conductive member 248 becomes exposed during a loadbreak operation, and a flashover event may occur when the arc passes through the surrounding air to conductive shield 314. Thus, the flashover distance can be defined as the longitudinal distance between the exposed portion of conductive member 248 and conductive shield 314. As shown in FIGS. 8 and 9, a longitudinal distance $D_1$ is defined between end of nose tip 324 and conductive jacket 314. $D_1$ would define the flashover distance between conductive member 248 and conductive shield 314 if nose tip 324 defined a stationary longitudinal end of bushing insert 300 during loadbreak and insulating jacket 318 were not present. That is, once elbow connector 200 is pulled away from bushing insert 300, conductive member 248 moves along axis 301 away from bushing insert 300, and conductive member 248 would become exposed at a portion that was initially surrounded by nose tip 324 (and by second end of tubular support sleeve 346 that is flush with nose tip 324). A flashover arc at the initial point of exposure of conductive member 248 would only have to travel over the distance $D_1$ to a portion of conductive shield 314 adjacent vent ring 320 in order for a flashover event to occur. Bushing insert 300 includes additional measures to increase the flashover distance beyond the distance $D_1$ as described further below.

In the exemplary embodiment, insulating jacket 318 is positioned longitudinally over conductive shield 314 a distance $D_2$. Conductive shield 314 is therefore not externally exposed over the distance $D_2$, and a flashover arc must travel from exposed conductive member 248 over the sum of distances $D_1$ and $D_2$ to the exposed portion of conductive shield 314 in order for a flashover event to occur. Insulating jacket 318 thereby increases the flashover distance by the distance $D_2$.

As shown in FIG. 8, when insulating sleeve is in the retracted position, insulating coupling 386 extends a longitudinal distance $D_3$ between support sleeve end 376 and second end 396 of insulating sleeve. During loadbreak, conductive member 248 becomes exposed at a point that was initially surrounded by second end 396 of insulating sleeve 388, and a flashover arc must travel over the sum of distances $D_1$, $D_2$ and $D_3$ in order for a flashover event to occur. Thus, even without additional longitudinal movement of insulative sleeve 388 along axis 301, insulating coupling 386 increases the flashover distance by the distance $D_3$.

As shown in FIG. 9, when elbow connector 200 is pulled away from bushing insert 300 during a loadbreak operation, and, more particularly, as contact holder 246 is moved away from first end 396 of insulating sleeve 388, biasing spring 392 is allowed to extend and as a result urges insulating sleeve 388 outward from cavity 378. Second end 396 of insulating sleeve 388 is thereby located a longitudinal distance $D_4$ from the head of gland nut 390. Insulating sleeve 388 thus continues to circumferentially cover conductive member 248 of male probe 242 over the distance $D_4$ as the elbow connector 200 is pulled away from bushing insert 300. Once conductive member 248 becomes exposed and uncovered by insulating sleeve 388, a flashover arc must travel over the sum of distances $D_1$, $D_2$, $D_3$, and $D_4$ in order for a flashover event to occur. Thus, by providing insulating sleeve 388 that moves to an extended position during loadbreak, coverage of conductive member 248 is maintained for a longer duration and increases the flashover distance by the distance $D_4$.

In addition, moveable female contact 344, tubular support sleeve 346, and piston 348 move along the longitudinal axis 301 away from stationary contact member 350 during the loadbreak operation. Probe 242 remains fitted within female contact 344 until piston 348 contacts an inwardly directed circumferentially extending stop 370 formed in an inner surface of metallic housing 338 which limits longitudinal movement of piston 348 in the longitudinal direction toward first end 302. As a result, second end 376 of tubular support sleeve 346 is located a longitudinal distance $D_5$ from nose tip 324 during the loadbreak operation. Insulating sleeve 388, which is a part of insulating coupling 386 connected to second end 376, thus continues to circumferentially cover conductive member 248 of male probe 242 over the distance $D_5$ as the elbow connector 200 is pulled away from bushing insert 300. Once conductive member 248 becomes exposed and uncovered by insulating sleeve 388, a flashover arc must travel over the sum of distances $D_1$, $D_2$, $D_3$, $D_4$, and $D_5$ in order for a flashover event to occur. Thus, moveable tubular support sleeve 346 allows insulating sleeve 388 to cover conductive member 248 for a longer duration and increases the flashover distance by the distance $D_5$.

Bushing insert 300 therefore increases a flashover distance from the initial distance $D_1$ by the sum of distances $D_2$, $D_3$, $D_4$, and $D_5$. The extended distance significantly reduces a risk of flashover between conductive member 248 of male probe 242 and conductive shield 314. In particular, once the conductive member 248 becomes exposed during a loadbreak operation, a flashover arc must travel a sum of longitudinal distances $D_1$, $D_2$, $D_3$, $D_4$, and $D_5$ between conductive member 248 and conductive shield 314 in order for a flashover event to occur. Suitably, this increased flashover distance may be such that a flashover event could not reasonably occur during loadbreak even when the surrounding air has reduced dielectric strength. Additionally, bushing insert 300 facilitates increasing a duration over which conductive member 248 remains covered by insulating sleeve 388 during loadbreak. That is, conductive member 248 remains covered over the distance $D_4$ as insulating sleeve 388 moves to the extended position and over the distance $D_5$ as tubular support sleeve 346 moves along axis 301 during loadbreak, thereby increasing a duration between a time at which loadbreak is initiated and a time at which conductive member 248 becomes exposed outward from second end 396 of insulating sleeve 388. The reduction in dielectric strength of air along the interface between elbow connector 200 and bushing insert 300 is a transient condition, and increasing the duration over which the conductive member 248 remains covered during loadbreak allows the pressure of air within cavity 224 to approach ambient conditions and restore the dielectric strength of the air. As the dielectric strength of the air increases to normal conditions, a flashover risk is substantially reduced.

The above-described embodiments of a bushing insert thus provide technical advantages by facilitating the minimizing of flashover risk during a loadbreak operation. More particularly, the embodiments described herein provide a bushing insert for a separable connector that includes an extendable insulating sleeve that maintains coverage of an electrically active portion of a male probe of an elbow connector of the separable connector during loadbreak, and increases a flashover distance between the male probe and exposed outer conductive portions of the bushing insert. Moreover, the embodiments described herein are useable with known elbow connectors in the field, facilitating greater usability of embodiments of the present disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A female electrical connector for use in a separable connector assembly, the female electrical connector comprising:

an elongate insulative body;

a female contact disposed within the body;

a tubular support sleeve extending between a first end and a second end, the first end connected to the female contact disposed within the body, the tubular support sleeve defining a cavity at the second end; and an insulating coupling connected to the second end of the tubular support sleeve, the insulating coupling comprising an insulating sleeve moveable between a retracted position, wherein the insulating sleeve is retracted within the cavity of the tubular support sleeve, and an extended position, wherein the insulating sleeve extends outward from the cavity and away from the second end of the tubular support sleeve and the insulating sleeve is moveable relative to the tubular support sleeve and the female contact.

2. The female electrical connector of claim 1, wherein the tubular support sleeve has an internally threaded inner surface at the second end, wherein the insulating coupling further comprises a gland nut surrounding the insulating sleeve, the gland having an externally threaded end threadably connected to the second end of the tubular support sleeve, the gland nut having a head end opposite the threaded end, the head end located outside the cavity.

3. The female electrical connector of claim 2, wherein the insulating sleeve has a first end and a second end, wherein, in the extended position, the first end of the insulating sleeve extends outward from the head end of the gland nut.

4. The female electrical connector of claim 3, wherein, in the retracted position, the first end of the insulating sleeve is substantially flush with the head end of the gland nut.

5. The female electrical connector of claim 3, wherein, in the extended position, the second end of the insulating sleeve is prevented from extending outward beyond the head end of the gland nut.

6. The female electrical connector of claim 2, further comprising a biasing spring disposed within the cavity, wherein the biasing spring moves the insulating sleeve from the retracted position to the extended position.

7. The female electrical connector of claim 1, further comprising a piston connected to the female contact, the piston adapted to move the female contact and the tubular support sleeve relative to the body.

8. The female connector of claim 7, wherein the piston comprises a snap ring, and wherein the female contact has a circumferential groove that receives the snap ring to connect the female contact to the piston.

9. The female connector of claim 8, wherein the female contact has an annular array of knurls that shear an interior surface of the piston when the female contact is connected to the piston.

10. A separable connector assembly comprising:

a male connector having a first end and a second end, the first end connected to an electric power cable, the second end having an opening, the male connector comprising a conductive male contact extending outward from the opening; and a female connector comprising:

an elongate insulative body having a first body end and a second body end, wherein the first body end is inserted into the opening of the second end of the male connector to form the separable connector assembly;

a conductive shield surrounding a portion of the body between the first body end and the second body end;

a female contact disposed within the body, wherein the female contact receives the male contact when the first end of the body is inserted into the male connector;

a tubular support sleeve extending between a first support sleeve end and a second support sleeve end, the first support sleeve end connected to the female contact disposed within the body, the tubular support sleeve defining a cavity at the second support sleeve end; and an insulating coupling connected to the second support sleeve end, the insulating coupling comprising an insulating sleeve moveable between a retracted position wherein the insulating sleeve is retracted within the cavity of the tubular support sleeve and an extended position wherein the insulating sleeve extends outward from the cavity and away from the second support sleeve end and the insulating sleeve is moveable relative to the tubular support sleeve and the female contact;

wherein the insulating sleeve moves to the extended position when the male connector is pulled away from the female connector to increase a longitudinal distance between an exposed portion of the male contact and an externally exposed portion of the conductive shield of the female connector.

11. The separable connector assembly of claim 10, wherein the female connector further comprises an insulating jacket surrounding a portion of the conductive shield, wherein the insulating jacket increases the longitudinal distance between the exposed portion of the male contact and the externally exposed portion of the conductive shield.

12. The separable connector assembly of claim 10, wherein the tubular support sleeve is moveable relative to the body between a first position and a second position, wherein movement of the tubular support sleeve from the first position to the second position causes the second support sleeve end to move away from the first body end to increase the longitudinal distance between the exposed portion of the male contact and the externally exposed portion of the conductive shield.

13. The separable connector assembly of claim 10, wherein the tubular support sleeve has an internally threaded inner surface at the second support sleeve end, wherein the insulating coupling further comprises a gland nut surrounding the insulating sleeve, the gland having an externally threaded end threadably connected to the second support sleeve end, the gland nut having a head end opposite the threaded end, the head end located outside the cavity.

14. The separable connector assembly of claim 13, wherein the gland nut increases the longitudinal distance between the exposed portion of the male contact and the externally exposed portion of the conductive shield.

15. The separable connector assembly of claim 14, wherein the insulating sleeve has a first end and a second end, wherein, in the extended position, the first end of the insulating sleeve extends outward from the head end of the gland nut.

16. The separable connector assembly of claim 15, wherein, in the extended position, the second end of the insulating sleeve is prevented from extending outward beyond the head end of the gland nut.

17. The separable connector assembly of claim 10, wherein movement of the insulating sleeve from the retracted position to the extended position increases a duration over which the male contact remains covered when the male connector is pulled away from the female connector.

18. The separable connector assembly of claim 17, wherein the tubular support sleeve is moveable relative to the body between a first position and a second position, wherein movement of the tubular support sleeve from the first position to the second position causes the second support sleeve end to move away from the first body end, and wherein the duration over which the male contact remains covered when the male connector is pulled away from the female connector is further increased by movement of the tubular support sleeve from the first position to the second position.

19. A separable connector assembly comprising:

a male connector having a first end and a second end, the male connector comprising a housing extending from the first end to the second end, the second end having an opening, the male connector further comprising a conductor contact positioned within the housing and a conductive male contact extending between a first contact end connected to the conductor contact and a second contact end located outward from the opening; and a female connector comprising:

an elongate insulative body having a first body end and a second body end, wherein the first body end is inserted into the opening of the second end of the male connector to form the separable connector assembly;

a female contact disposed within the body, wherein the female contact receives the second contact end of the male contact when the first end of the body is inserted into the male connector;

a tubular support sleeve extending between a first support sleeve end and a second support sleeve end, the first support sleeve end connected to the female contact disposed within the body, the tubular support sleeve defining a cavity at the second support sleeve end; and an insulating coupling connected to the second support sleeve end, the insulating coupling comprising an insulating sleeve having a first insulating sleeve end and a second insulating sleeve end, the insulating sleeve moveable between a retracted position wherein the first insulating sleeve end is located inside the cavity of the tubular support sleeve and an extended position wherein the first insulating sleeve end is located outside the cavity and the insulating sleeve is moveable relative to the tubular support sleeve and the female contact;

wherein the insulating sleeve moves to the extended position when the male connector is pulled away from the female connector such that the second insulating sleeve end continues to cover a portion of the male connector adjacent the first connector end over a longitudinal distance.

20. The separable connector assembly of claim 19, wherein the tubular support sleeve is moveable relative to the body between a first position and a second position, wherein movement of the tubular support sleeve from the first position to the second position causes the second support sleeve end to move away from the first body end and increases the longitudinal distance over which the second insulating sleeve end continues to cover the portion of the male connector when the male connector is pulled away from the female connector.

* * * * *